US005528869A

United States Patent [19]

Boomer et al.

[11] Patent Number: 5,528,869

[45] Date of Patent: Jun. 25, 1996

[54] BUILDING PRODUCT

[76] Inventors: Kenneth R. Boomer; James W. Boomer, both of 202 Belsize Road, Lisburn, County Antrim, Northern Ireland

[21] Appl. No.: 295,003

[22] Filed: Aug. 24, 1994

Related U.S. Application Data

[63] Continuation-in-part of Ser. No. 77,502, Jun. 17, 1993, which is a continuation of Ser. No. 841,992, Feb. 28, 1992, abandoned, which is a continuation-in-part of Ser. No. 588,590, Sep. 26, 1990, abandoned.

[30] Foreign Application Priority Data

Nov. 18, 1989 [GB] United Kingdom ..... 8926127

[51] Int. Cl.[6] ..... E06B 1/26

[52] U.S. Cl. ..... 52/212; 49/505; 52/217

[58] Field of Search ..... 52/211, 212, 215, 52/217, 204.53, 204.54; 49/504, 505

[56] References Cited

U.S. PATENT DOCUMENTS

| | | | |
|---|---|---|---|
| 1,048,988 | 12/1912 | Mayo, Sr. | 52/217 |
| 2,454,523 | 11/1948 | Philip | 52/212 |
| 3,349,519 | 10/1967 | Nehlig | 52/211 |
| 3,545,135 | 12/1970 | Lieber | 49/505 |
| 3,609,928 | 10/1971 | Mock | 49/505 |
| 3,800,488 | 4/1974 | Swanson | 49/505 |
| 3,884,003 | 5/1975 | Herr et al. | 52/212 |
| 4,019,303 | 4/1977 | McAllister | 49/505 |
| 5,203,130 | 4/1993 | Freelove | 52/211 |
| 5,345,722 | 9/1994 | McKann | 52/212 |

*Primary Examiner*—Michael Safavi
*Attorney, Agent, or Firm*—Lane, Aitken & McCann

[57] ABSTRACT

A facing for a wall end opening which comprises first and second longitudinally extending strip members extruded of synthetic plastics material. Each strip member is formed with a wall face engageable part and a wall end engageable part. The wall engageable part of the first strip includes a stop protrusion formed integrally therewith, having a slot formed therein to accommodate a variable portion of the wall end engageable part of the second strip whereby the depth of the facing can be varied, in use. The stop protrusion portion together with the further portion of the first strip are of hollow triangular transverse cross-section and are hingedly located to the wall end engageable part of the first strip to facilitate simultaneous printing of the outer surface, in use, of the wall end engageable part and the stop protrusion portion.

5 Claims, 4 Drawing Sheets

BUILDING PRODUCT

This application is a continuation-in-part of application Ser. No. 08/077,502, Jun. 17, 1993, which is a continuation of Ser. No. 07/841,992, Feb. 28, 1992 now abandoned, which is a continuation-in-part of application Ser. No. 07/588,590, Sep. 26, 1990 now abandoned.

The invention relates to building products and more particularly to facing strips for use around wall edges or openings.

In the manufacture of mobile or prefabricated homes it is becoming standard practice to provide edge facings for wall ends and at window and door frames. Such facings are usually provided as strips extruded of synthetic plastics material and may include stop sections for windows or doors, integrally formed as part of such strip. Although such strips can be manufactured at a relatively cheap unit price, the moulds are extremely expensive. When it is required to provide and stock a number of various depth facings to fit various wall thicknesses the storage space and mould costs can become prohibitive.

It is an object of the invention to obviate or mitigate the above disadvantages.

It is a further object of the invention to provide a facing for a wall end opening which is extruded of synthetic plastics material and is formed to facilitate printing of a required aesthetic finish to the outer surfaces thereof.

According to one aspect of the invention there is provided a facing for a wall end opening which comprises first and second longitudinally extending strip members extruded of synthetic plastics material wherein each strip member is formed with a wall face engageable part and a wall end engageable part, the wall end engageable part of the first strip including a stop protrusion portion formed integrally therewith and having a further portion formed integrally therewith extending towards the wall end engageable part to provide a slot to accommodate a variable portion of the wall end engageable part of the second strip whereby the depth of the facing can be varied, in use, the stop protrusion portion together with the further portion being of hollow triangular transverse cross-section and being hingedly located to the wall end engageable part of the first strip to facilitate simultaneous printing of the outer surface, in use, of the wall end engageable part and the stop protrusion portion.

The first strip member may be extruded of rigid synthetic plastics material with a weakened portion at the wall end engageable part where it abuts the stop protrusion portion, a layer of flexible plastics material being extruded to extend over said weakened portion on the inner surface, in use, of the wall end engageable part.

During manufacture the first strip member may be extruded by feeding both of the rigid and flexible plastics material to a single extrusion die for concurrent extrusion thereof.

The foregoing and further features of the invention may be more readily understood from the following description of some preferred embodiments thereof, by way of example, with reference to the accompanying drawing, in which.

Figure 1:
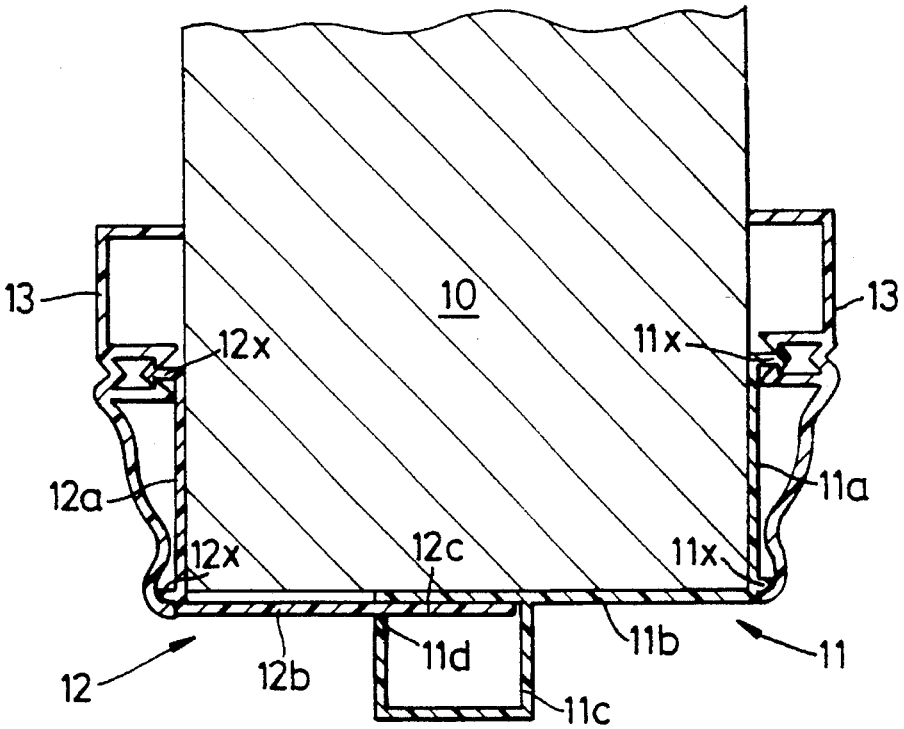
FIG. 1 is a transverse sectional view of a wall end with facing attached thereto.

Referring now to FIG. 1 of the drawing there is shown a transverse sectional view of the end of a wall having a facing comprising first and second strips 11 and 12 attached thereto. Each of the strips 11 and 12 include a wall face engaging part 11*a* and 12*a* respectively and a wall end engaging part 11*b* and 12*b* respectively. A stop portion 11*c*, which is of hollow rectangular cross-section is formed integrally with part 11*b* of strip 11. A slot 11*d* is formed in stop portion 11*c* so as to allow passage of the end portion 12*c* of part 12*b* of strip 12 to locate within stop portion 11*c*. The outer surfaces of parts 11*a* and 12*b* are each formed with respective protrusions 11*x* and 12*x* to facilitate the snap-on attachment of respective architrave or casing members 13 thereto.

In use a suitable length of strip 11 is attached to one face of wall 10 by stapling or otherwise fixing through part 11*a*. A similar length of strip 12 is then located with its edge 12*c* through slot 11*d* until part 12*a* abuts the other face of wall 10 and part 12*a* is then stapled or otherwise fixed to wall 10. This sequence can be repeated around a door opening with the corners being mitred and a door can then be hung in standard manner and architrave or casing members 13 attached thereto.

By having edge 12*c* engaging with slot 11*d* a facing can be produced which will locate on for example, a nominal three or four inch wall thickness but can be of variable depth by about ⅝ inches so as to accommodate different thicknesses of wall sheet finishes of each face of wall 10.

Figure 2:
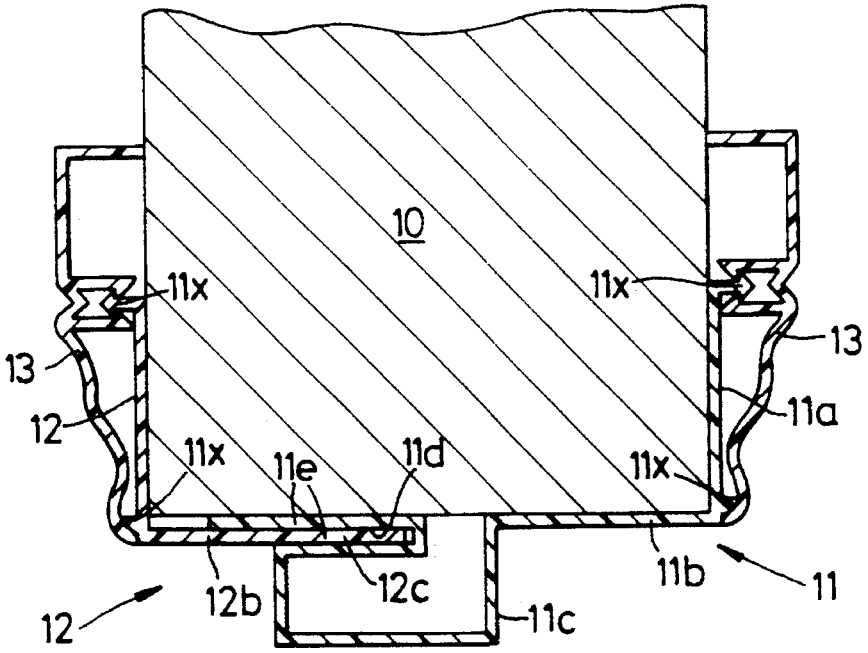
FIG. 2 is a view similar to FIG. 1 of a further alternative embodiment of facing.

FIG. 2 shows a similar arrangement to that of FIG. 1 except that slot 11*d* is formed between two wall members 11*e* of stop portion 11*c* to engage opposed surfaces of edge 12*c* when located therein. Such an arrangement provides a more positive location of edge 12*c* and is more conveniently manufactured when the strips 11 and 12 are extruded of synthetic plastics material.

Figure 3:
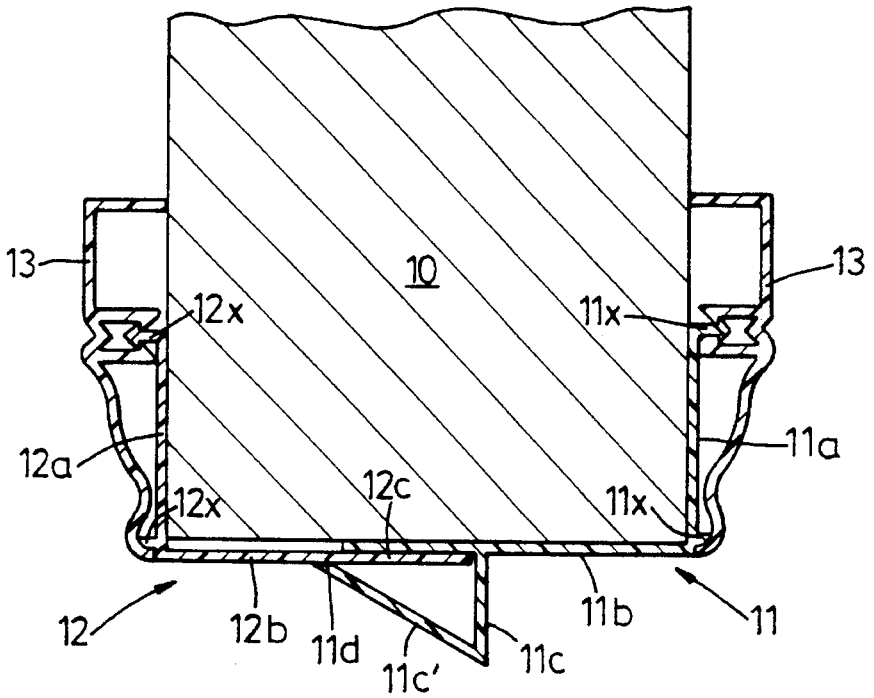
FIG. 3 is a view similar to FIG. 1 of a further alternative embodiment of facing.

FIG. 3 shows a similar arrangement to that of FIG. 1 except that a portion 11*c*' of stop portion 11*c* is formed to depend at an angle therefrom and extend to abut part 12*c* of strip 12. Such an arrangement reduces the amount of material required for strip 11 and a positive attachment can be provided by forming portion 11*c* to abut part 12*c* under a small pressure.

Figure 4:
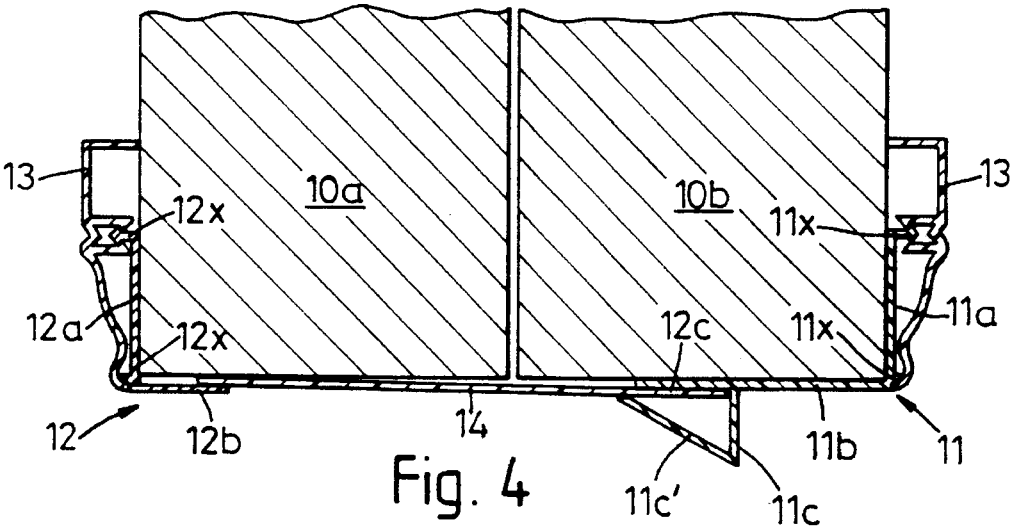
FIG. 4 is a view similar to FIG. 3 of the facing being utilized with a marriage wall.

FIG. 4 shows a similar arrangement to that of FIG. 3 except for use with marriage walls where, for example, two parts of a mobile home are joined together giving a double wall width. In such an arrangement sheet 12 is attached to one wall 10*a* and sheet 11 is attached to the other wall 10*b*. A flat sheet 14 is then located with one edge beneath part 12*b* and the other edge located beneath portion 11*c*. Hence the arrangement provides a closure for any gap around the opening between the two walls 10*a* and 10*b* as well as providing a stop member and surround for the opening.

Figure 5:
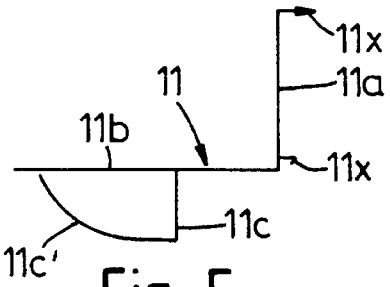
FIGS. 5, 6 and 7 are schematic transverse sectional views of alternative facing configurations.
Figure 6:
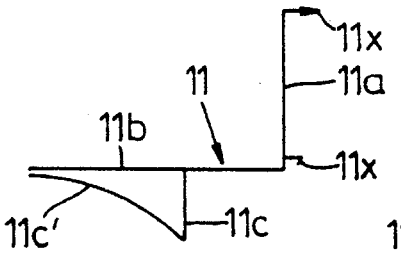
Figure 7:
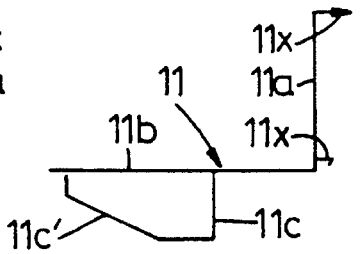

FIGS. 5, 6 and 7 show alternative schematic transverse sectional views for portion 11*c* to that shown in FIG. 3.

Figure 8A:
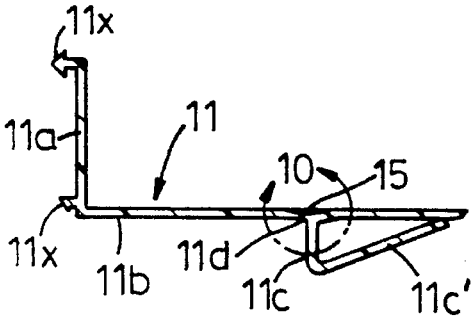
FIGS. 8A, 8B and 8C are schematic transverse sectional views of an alternative facing shown in different hinged positions.
Figure 8B:
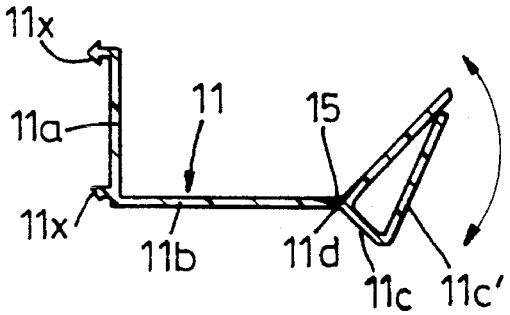
Figure 8C:
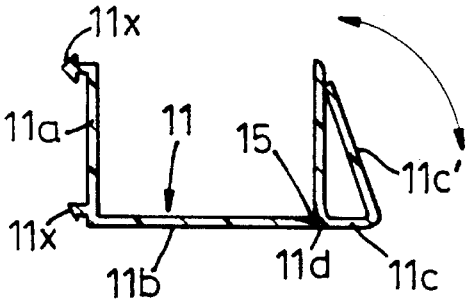

Referring now to FIGS. 8A, 8B, 8C and 10, there is shown a strip 11 which is similar to that of FIG. 3 except the wall end engaging part 11*b* is formed with a hinge at position 11*d* adjacent the position at which stop portion 11*c* protrudes from part 11*b*. The hinge is formed by providing a groove of V-shape cross-section extending longitudinally along the strip 11 to define a weakened portion on the wall engaging face of part 11*b* at position 11*d* and by providing a layer 15 of flexible material in the groove, over such weakened portion. The strip 11 of FIG. 8A is extruded of a rigid synthetic plastics material whilst the layer 15 is extruded of a flexible synthetic plastics material, both such materials being fed to a single extrusion die for concurrent extrusion. By "rigid" is meant substantially rigid in the form of a strip 11 or 12 of the present invention in normal use, although sufficiently flexible to allow the architrave members 13 to be snapped-on. Both such rigid and flexible materials may be polyvinylchloride. Where polyvinylchloride is used as both the rigid material and the flexible material, the rigid material is unplasticized polyvinylchloride and the flexible material is plasticized polyvinylchloride. As an alternative, ABS plastic can be used as the rigid plastics material and nitrile rubber can be used as the flexible plastics material. It is also contemplated that the layer 15 of the flexible synthetic plastics material can be omitted and the hinge defined solely by the weakened portion at the position 11*d* at the bottom of the groove.

Figure 9A:
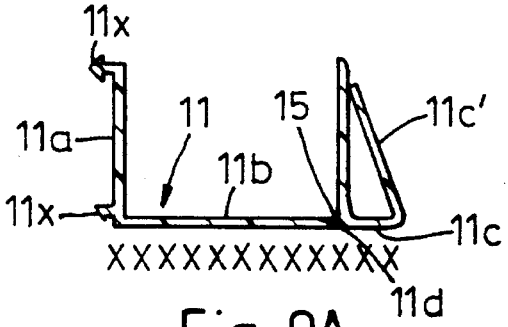
FIGS. 9A, 9B and 9C are schematic transverse sectional views of the facing of FIGS. 8A, 8B and 8C showing positions for printing thereof.
Figure 9B:
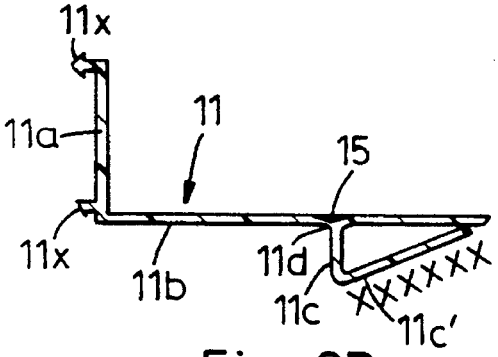
Figure 9C:
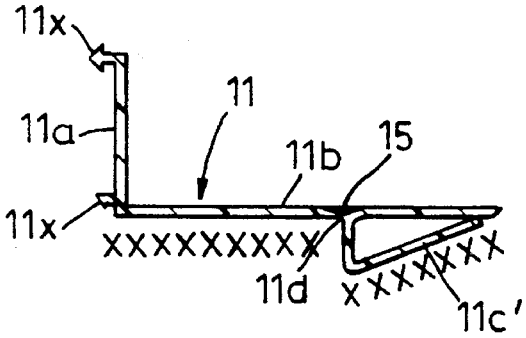
Figure 10:
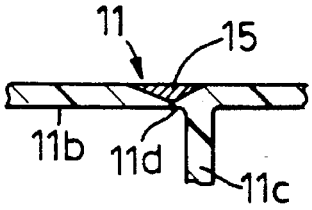
FIG. 10 is an enlargement of the portion of FIG. 8A encircled by the arrow 10.

By making strip 11 as described above facilitates printing of the surfaces of strip 11 which are exposed, in use, with an aesthetically appealing finish, such as a wood grain effect. The printing process is carried out by bending part 11*b* about hinge position 11*d* to the configuration shown in FIG. 9A for a first print run to print the surfaces marked x in FIG. 9A. The part 11*b* is then returned to its flat position and located as shown in FIG. 9B for a second print run to print the surface 11*b* marked x in FIG. 9B. FIG. 9C shows the strip 11 with surfaces to be exposed, in use, marked x having been printed. With such an arrangement the surface 12*b* of strip 12 and members 13 would be similarly printed on their surfaces to be exposed, in use.

In an alternative method of producing strip 11 the rigid portion may be extruded and subsequently the flexible layer 15 extruded or otherwise applied over the weakened portion with preheating of the rigid portion if necessary.

Figure 11:
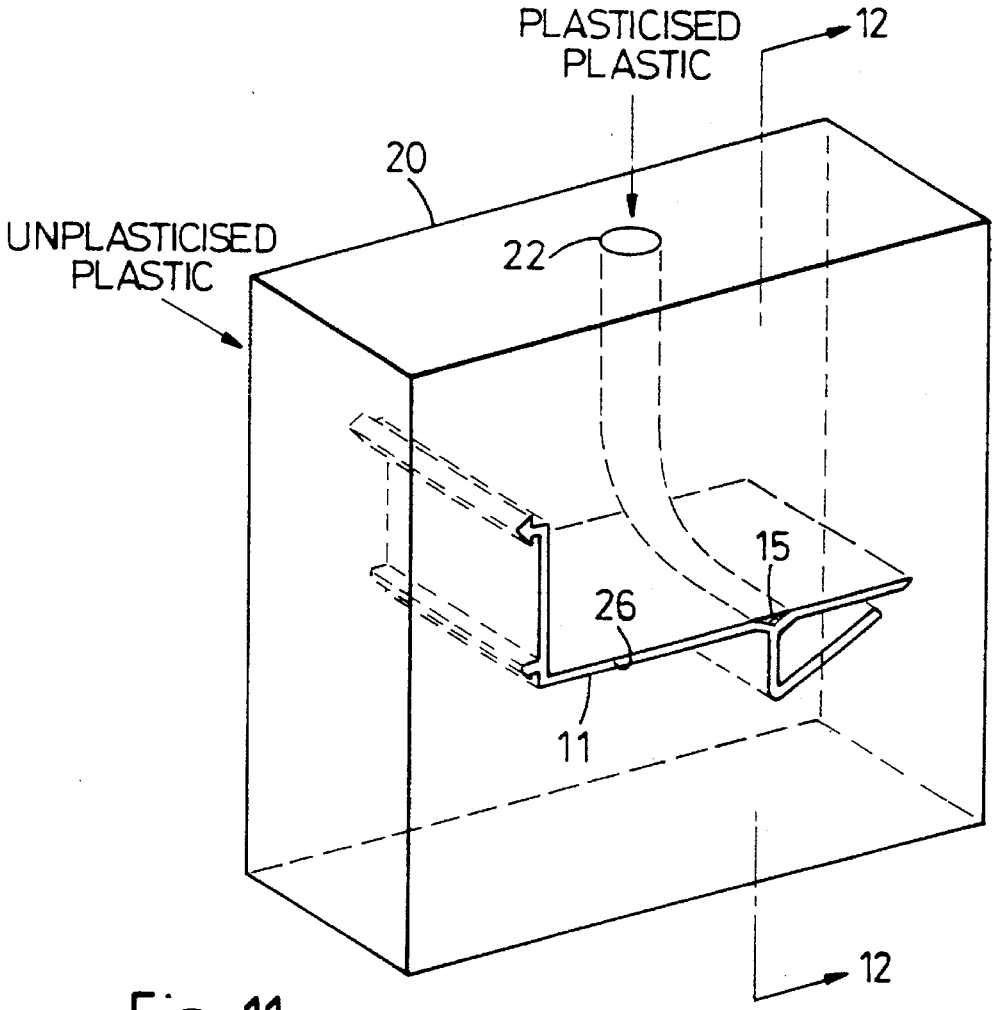
FIG. 11 is a schematic perspective view of a facing strip being formed with a die in accordance with the present invention.
Figure 12:
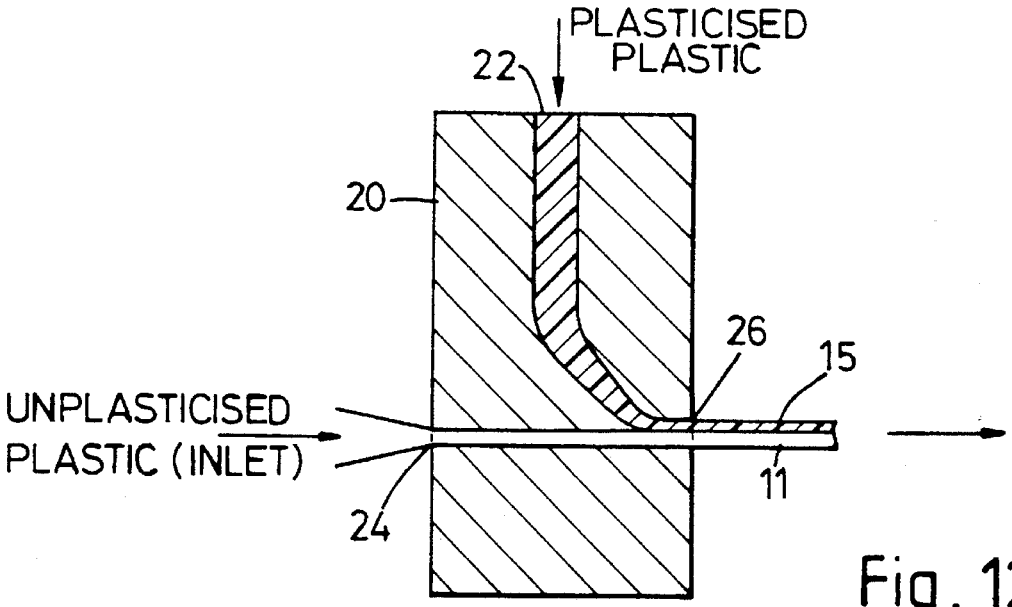
FIG. 12 is a cross-section taken along the line 12—12 in FIG. 11.

As can be seen from FIGS. 11 and 12, the strip 11 of FIG. 8A can be formed using conventional plastics extrusion techniques and a die 20 having an inlet 22 for the flexible synthetic plastics material and an inlet 24 for the rigid synthetic plastics material. The inlets 22 and 24 lead to respective internal passages which merge just prior to an outlet 26 such that the flexible synthetic plastics material is brought into contact with the rigid synthetic plastics material and becomes bonded thereto.

Having thus described the present invention and its preferred embodiments in detail, it will be readily apparent to those skilled in the art that further modifications to the invention may be made without departing from the spirit and scope of the invention as presently claimed.

What is claimed is:

1. A facing for a wall end opening which comprises first and second longitudinally extending strip members extruded of synthetic plastics material wherein each strip member is formed with a wall face engageable part and a wall end engageable part, the wall end engageable part of the first strip member including a stop protrusion portion formed integrally therewith and having a slot formed therein to accommodate a variable portion of the wall end engageable part of the second strip member whereby the depth of the facing can be varied, in use, the stop protrusion portion being of hollow triangular transverse cross-section and being hingedly located to the wall end engageable part of the first strip member to facilitate simultaneous printing of the outer surface, in use, of the wall end engageable part and the stop protrusion portion, the first strip member having a weakened portion at the wall end engageable part where it abuts the stop protrusion portion.

2. A facing as claimed in claim 1 wherein the first strip member is extruded of rigid synthetic plastics material, a layer of flexible synthetic plastics material being attached to said weakened portion to extend over said weakened portion on the inner surface, in use, of the wall end engageable part.

3. A facing as claimed in claim 2 wherein said rigid and flexible materials are polyvinylchloride.

4. In combination, a wall having a wall end and wall faces, and a facing comprising first and second longitudinally extending strip members extruded of synthetic plastics material wherein each strip member is formed with a part engaging one of said wall faces and a part engaging the wall end, the wall end engaging part of the first strip member including a stop protrusion portion formed integrally therewith and having a slot formed therein accommodating a portion of the wall end engaging part of the second strip member, the stop protrusion portion being of hollow triangular transverse cross-section and being hingedly located to the wall end engaging part of the first strip member to facilitate simultaneous printing of the outer surface of the wall end engaging part and the stop protrusion portion, the wall end engaging part of the first strip member having a side facing toward said wall end, said side lying entirely in one plane, the first strip member having a weakened portion at the wall end engaging part where the wall end engageable part abuts the stop protrusion portion.

5. A facing for a wall opening which comprises first and second longitudinally extending strip members extruded of synthetic plastics material wherein each strip is formed with a wall face engageable part and a wall end engageable part, the wall end engageable part of the first strip member including a stop protrusion portion formed integrally therewith, the stop protrusion portion being hingedly connected to the wall end engageable part of the first strip member to facilitate simultaneous printing of the outer surface, in use, of the wall end engageable part and the stop protrusion portion, the first strip member having a weakened portion at the wall end engageable part where the wall end engageable part abuts the stop protrusion portion, wherein said first strip member is a one-piece member.

* * * * *